US010383414B2

(12) United States Patent
Tan

(10) Patent No.: US 10,383,414 B2
(45) Date of Patent: Aug. 20, 2019

(54) FOLDING COLLAPSIBLE LUGGAGE

(71) Applicant: Fu-Hsing Tan, Taoyuan Hsien (TW)

(72) Inventor: Fu-Hsing Tan, Taoyuan Hsien (TW)

( * ) Notice: Subject to any disclaimer, the term of this patent is extended or adjusted under 35 U.S.C. 154(b) by 71 days.

(21) Appl. No.: 15/664,823

(22) Filed: Jul. 31, 2017

(65) Prior Publication Data

US 2019/0029379 A1 Jan. 31, 2019

(51) Int. Cl.

| | |
|---|---|
| ***A45C 7/00*** | (2006.01) |
| ***A45C 5/03*** | (2006.01) |
| ***A45C 5/14*** | (2006.01) |
| ***A45C 13/26*** | (2006.01) |
| ***A45C 13/02*** | (2006.01) |

(52) U.S. Cl.

CPC ..... *A45C 7/0036* (2013.01); *A45C 5/03* (2013.01); *A45C 5/14* (2013.01); *A45C 13/02* (2013.01); *A45C 13/262* (2013.01); *A45C 2013/026* (2013.01); *A45C 2013/267* (2013.01)

(58) Field of Classification Search

CPC ..... A45C 7/0036; A45C 5/03; A45C 5/14; A45C 13/262; A45C 2013/267

See application file for complete search history.

(56) References Cited

U.S. PATENT DOCUMENTS

| | | | | |
|---|---|---|---|---|
| 2,479,269 | A * | 8/1949 | Schneider | A45C 13/02 190/109 |
| 7,175,010 | B1 * | 2/2007 | Miner | A45C 7/0036 190/107 |
| 2004/0071371 | A1 * | 4/2004 | Maher | B65D 31/12 383/38 |
| 2005/0034948 | A1 * | 2/2005 | Tiramani | A45C 7/0022 190/107 |
| 2007/0034626 | A1 * | 2/2007 | Warren | A45C 7/0036 220/9.2 |
| 2007/0205243 | A1 * | 9/2007 | Potts | B60R 7/02 224/539 |
| 2013/0043293 | A1 * | 2/2013 | Connell | A45F 3/04 224/652 |
| 2016/0316877 | A1 * | 11/2016 | Mosee | A45C 1/02 |

* cited by examiner

*Primary Examiner* — Tri M Mai

(57) ABSTRACT

A folding collapsible luggage includes a folding collapsible luggage body, a hard support plate hinged to an inner surface of the back panel of the luggage body and adapted for supporting the luggage body in shape, and connection devices mounted between two opposite lateral sides of the support plate and two opposite side panels of the luggage body and adapted for detachably fastening the support plate to the two opposite side panels of the luggage body in the operative position where the support plate divides the inside space of the luggage body into two vertically spaced storage compartments.

5 Claims, 8 Drawing Sheets

FOLDING COLLAPSIBLE LUGGAGE

BACKGROUND OF THE INVENTION

1. Field of the Invention

The present invention relates to luggage technology and more particularly, to a folding collapsible luggage, which comprises a folding collapsible luggage body, a support plate transversely hinged to a middle part of the inside wall of the back panel of the luggage body, and connection devices for detachably securing the support plate in the operative position to divide the inside space of the luggage body into two vertically spaced storage compartments.

2. Description of the Related Art

The luggage bodies of commercial luggage are commonly made of hard sheet material, and therefore they are not folding collapsible. There are soft shell luggage designs commercially available. However, these soft shell luggage designs are soft and their shape can easily be deformed. Further, it is difficult to divide the inside space of a soft shell luggage into multiple vertically spaced storage compartments, causing inconvenience to the user.

SUMMARY OF THE INVENTION

The present invention has been accomplished under the circumstances in view. It is therefore the main object of the present invention to provide a folding collapsible luggage, which uses a hinged support plate for supporting the folding collapsible luggage body in shape and dividing the inside space of the luggage body into two vertically spaced storage compartments, facilitating user use of the luggage.

To achieve this and other objects of the present invention, a folding collapsible luggage comprises a luggage body, a support plate and two connection devices. The luggage body is made of a folding collapsible material, comprising a back panel, two side panels respectively connected to two opposite lateral sides of the back panel, a top panel connected to a top side of the back panel, a substantially ⊓-shaped partition space portion transversely defined on a middle part of the back panel and a respective middle part of each side panel, and a V-shaped folding line formed on each side panel with two opposite ends thereof abutted to the back panel and a midpoint thereof located on the respective side panel within the partition space portion and remote from the back panel. The support plate comprises a plate body, and a hinge strip connected between the plate body and a part of the back panel of the luggage body within the partition space portion. The plate body comprises two bearing edges respectively located at two opposite lateral sides thereof and respectively abutted to two opposite ends of the hinge strip. The two connection devices each comprise a first connection member and a second connection member. The first connection members of the two connection devices are respectively mounted at the bearing edges of the plate body of the support plate. The second connection members of the two connection devices are respectively mounted at the side panels of the luggage body within the partition space portion for the connection of the respective first connection members. When fastening the first connection members of the connection devices to the respective second connection members, the bearing edges of the plate body of the support plate are respectively abutted against the side panels of the luggage body within the partition space portion. When unfastening the first connection members of the connection devices from the respective second connection members, the plate body of the support plate can be collapsed and closely abutted to the back panel of the plate body and the luggage body allows to be folded up through the folding lines.

DETAILED DESCRIPTION OF THE PREFERRED EMBODIMENT

Figure 1:
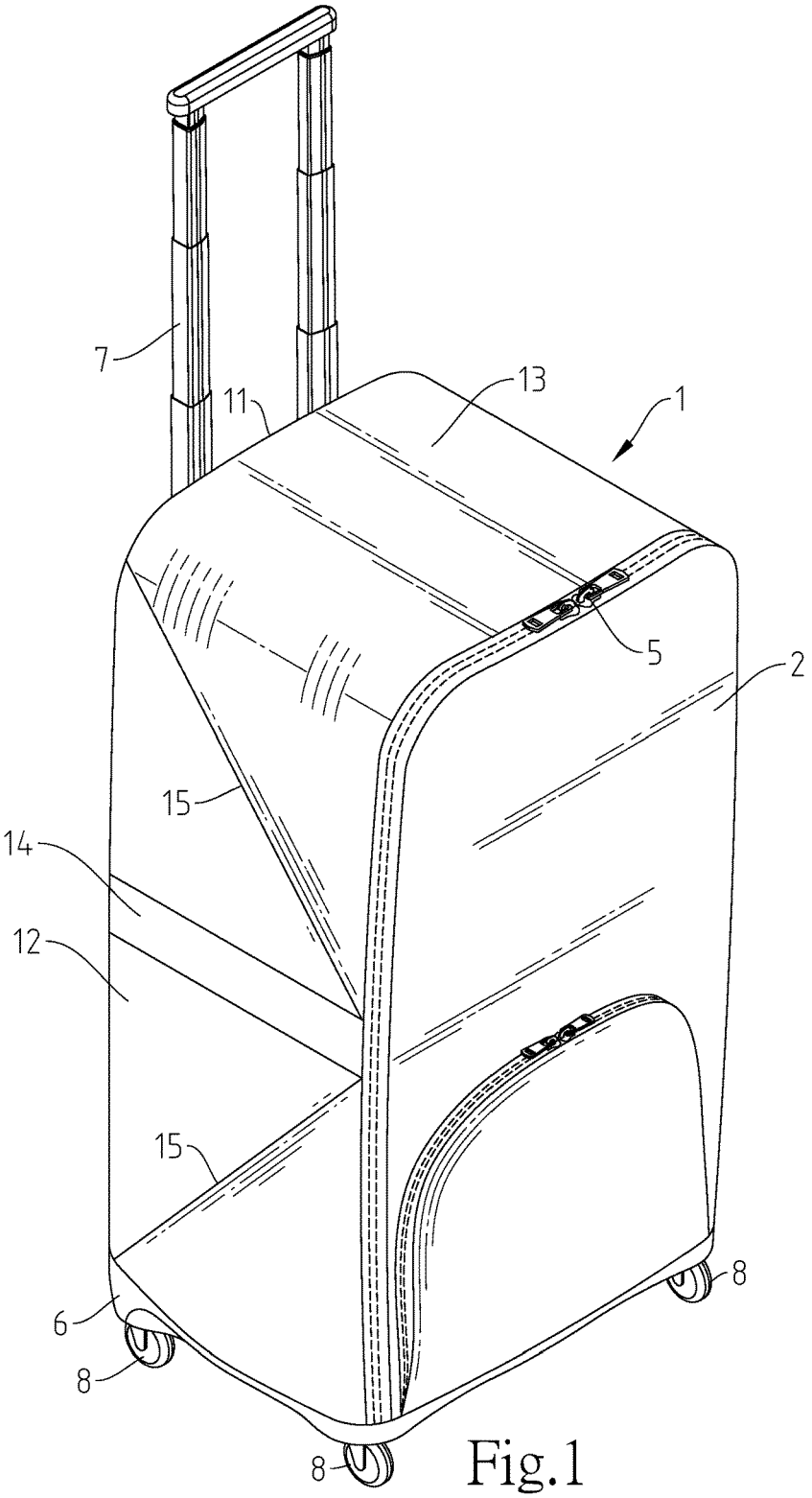
FIG. 1 is an oblique top elevation of a folding collapsible luggage in accordance with the present invention.

Referring to FIGS. 1-7, a folding collapsible luggage in accordance with the present invention is shown. The folding collapsible luggage comprises a luggage body 1, a cover panel 2, a support plate 3 and two connection devices 4.

The luggage body 1 is made of a folding collapsible material, comprising a back panel 11, two opposing side panels 12 respectively connected to two opposite lateral sides of the back panel 11, a top panel 13 connected to a top side of the back panel 11 and respective top sides of the side panels 12, a substantially ⊓-shaped partition space portion 14 transversely defined on a middle part of the back panel 11 and respective middle part of the side panels 12, and a V-shaped folding line 15 formed on each side panel 12 with two opposite ends thereof abutted to the back panel 11 and a midpoint thereof located on each side panel 12 within the partition space portion 14 and remote from the back panel 11.

The cover panel 2 is provided at a front side of the luggage body 1. Further, the cover panel 2 is made of a folding collapsible material. Further, a zip fastener 5 is mounted between a border edge of the cover panel 2 and respective border edges of the side panel 12 and top panel 13 of the luggage body 1. The zip fastener 5 is operable to close the cover panel 2 on the side panels 12 and top panel 13 of the luggage body 1 or to open the cover panel 2 from the side panels 12 and top panel 13 of the luggage body 1.

The support plate 3 comprises a hinge strip 31 and a plate body 32. The hinge strip 31 has two opposite lateral sides respectively connected to a rear side of the plate body 32 and a part of the partition space portion 14 of the luggage body 1 at the back panel 11. The plate body 32 comprises two bearing edges 321 respectively located at two opposite lateral sides thereof and respectively abutted to two opposite ends of the hinge strip 31. Further, the plate body 32 is made of a non-fordable hard material.

The connection devices 4 each comprise a first connection member 41 and a second connection member 42. The first connection members 41 of the two connection devices 4 are respectively mounted at the two bearing edges 321 of the support plate 3 remote from the hinge strip 31. The second connection members 42 of the two connection devices 4 are respectively mounted at the side panels 12 of the luggage body 1 within the partition space portion 14. In the present invention, the first connection members 41 are hook members; the second connection members 42 are strikers for the hooking of the hook type first connection members 41.

Further, the luggage body 1 and the cover panel 2 are mounted at a top side of a bottom block 6. The bottom block 6 is equipped with a retractable handle 7 at a rear side thereof, and a plurality of rollers 8 at an opposing bottom side thereof. Further, a part of the back panel 11 of the luggage body 1 below the partition space portion 14 is fastened to the retractable handle 7.

Figure 2:
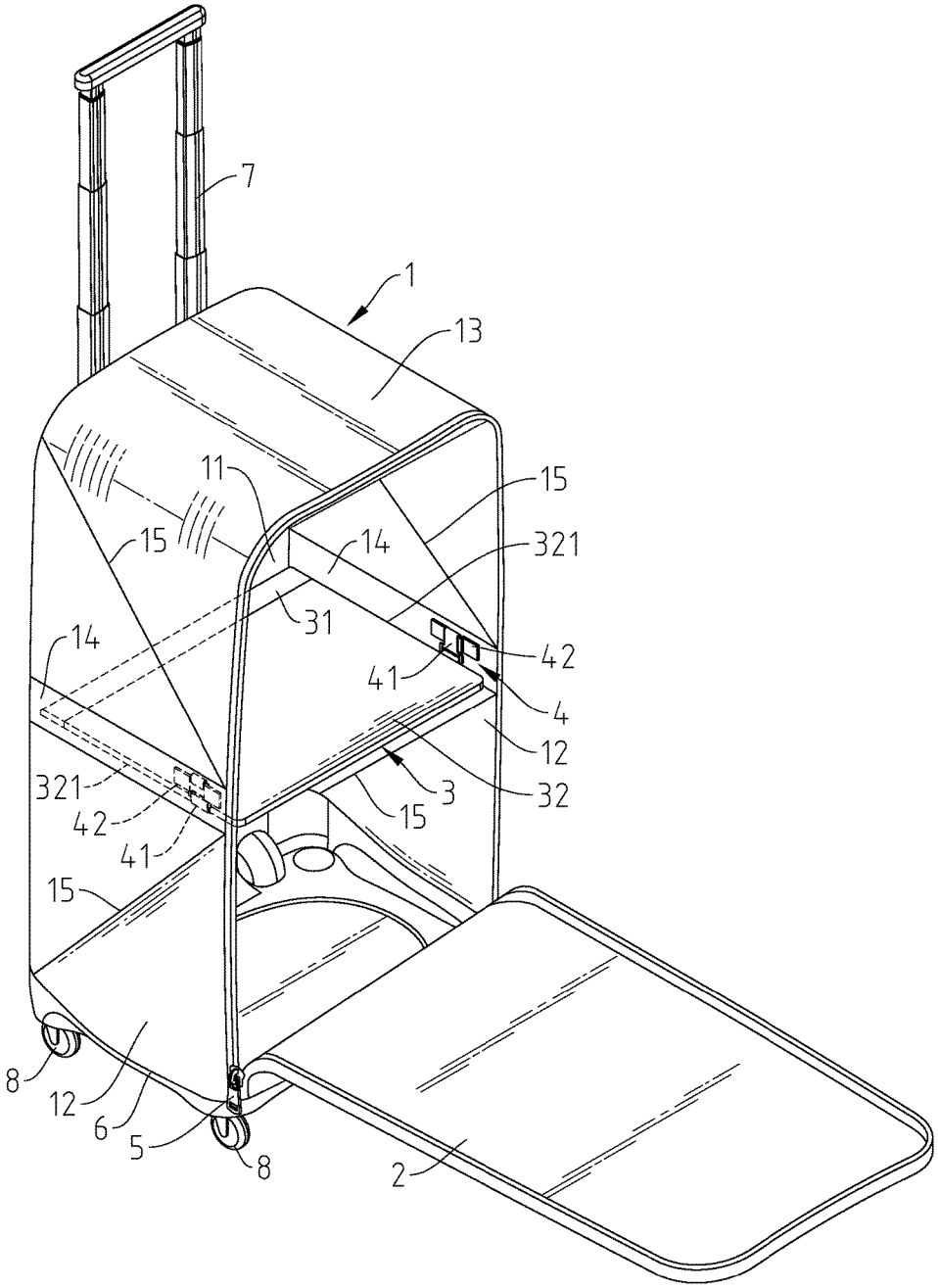
FIG. 2 is a perspective view of the present invention, illustrating the cover panel of the folding collapsible luggage opened.
Figure 3:
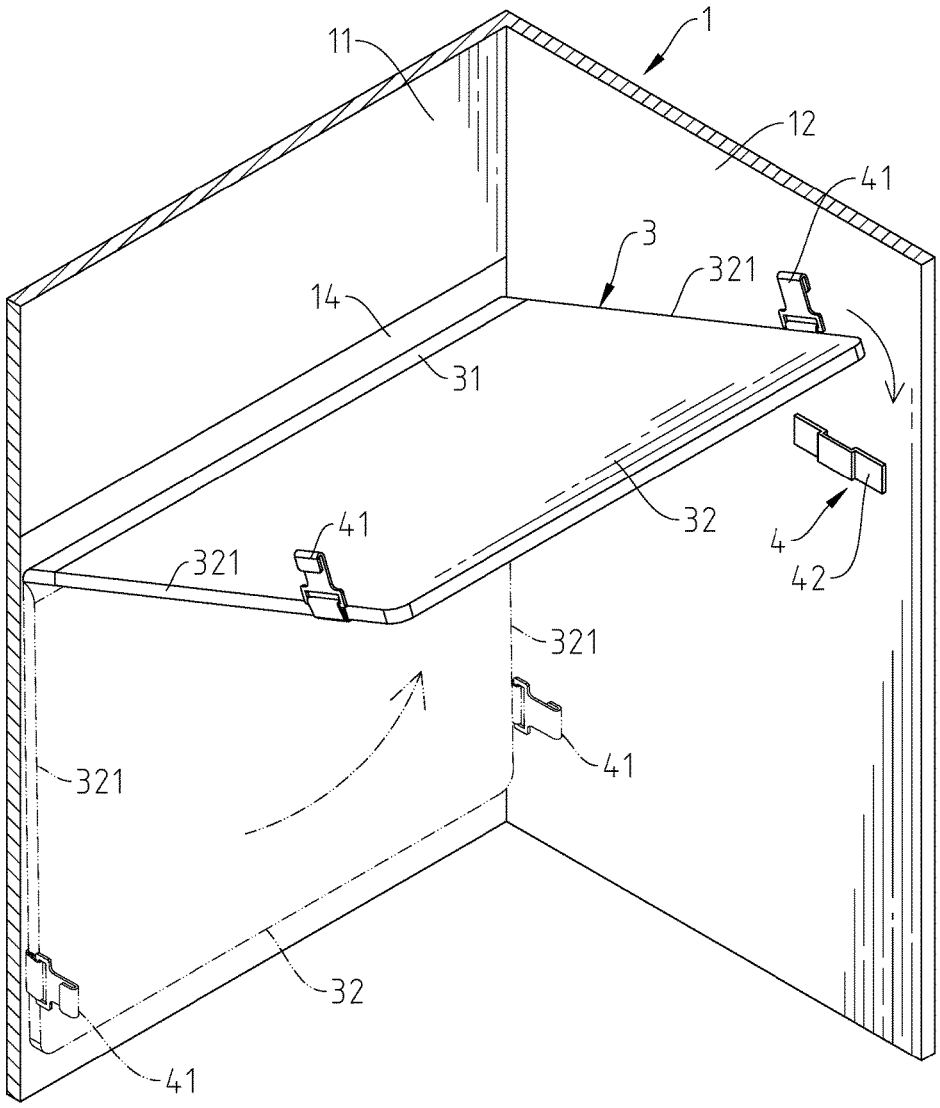
FIG. 3 is a schematic drawing illustrating the use of the connection devices to secure the plate body to the side panels of the luggage body.
Figure 4:
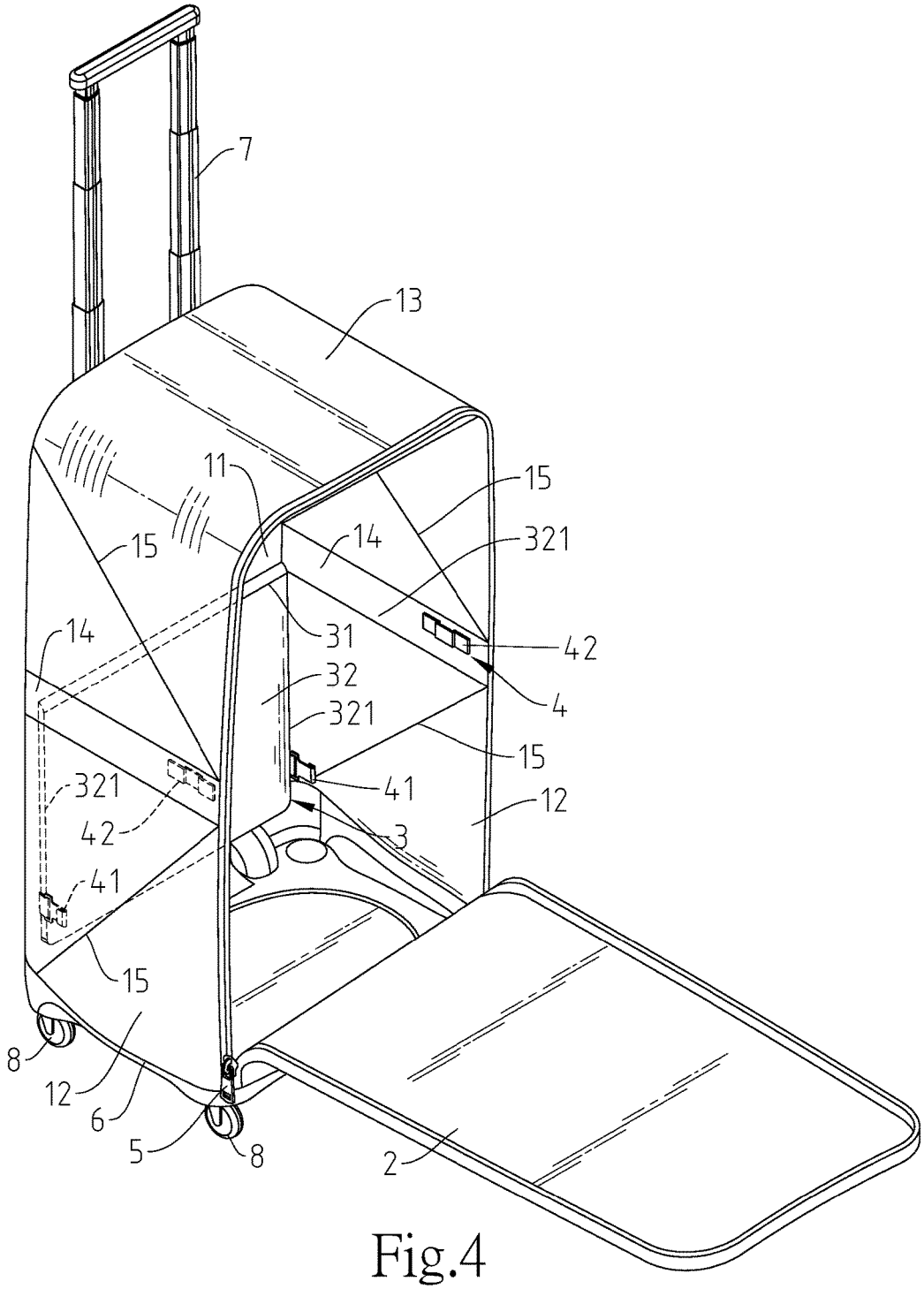
FIG. 4 is a schematic perspective view of the present invention, illustrating the support plate collapsed and attached onto the back panel of the luggage body.
Figure 5:
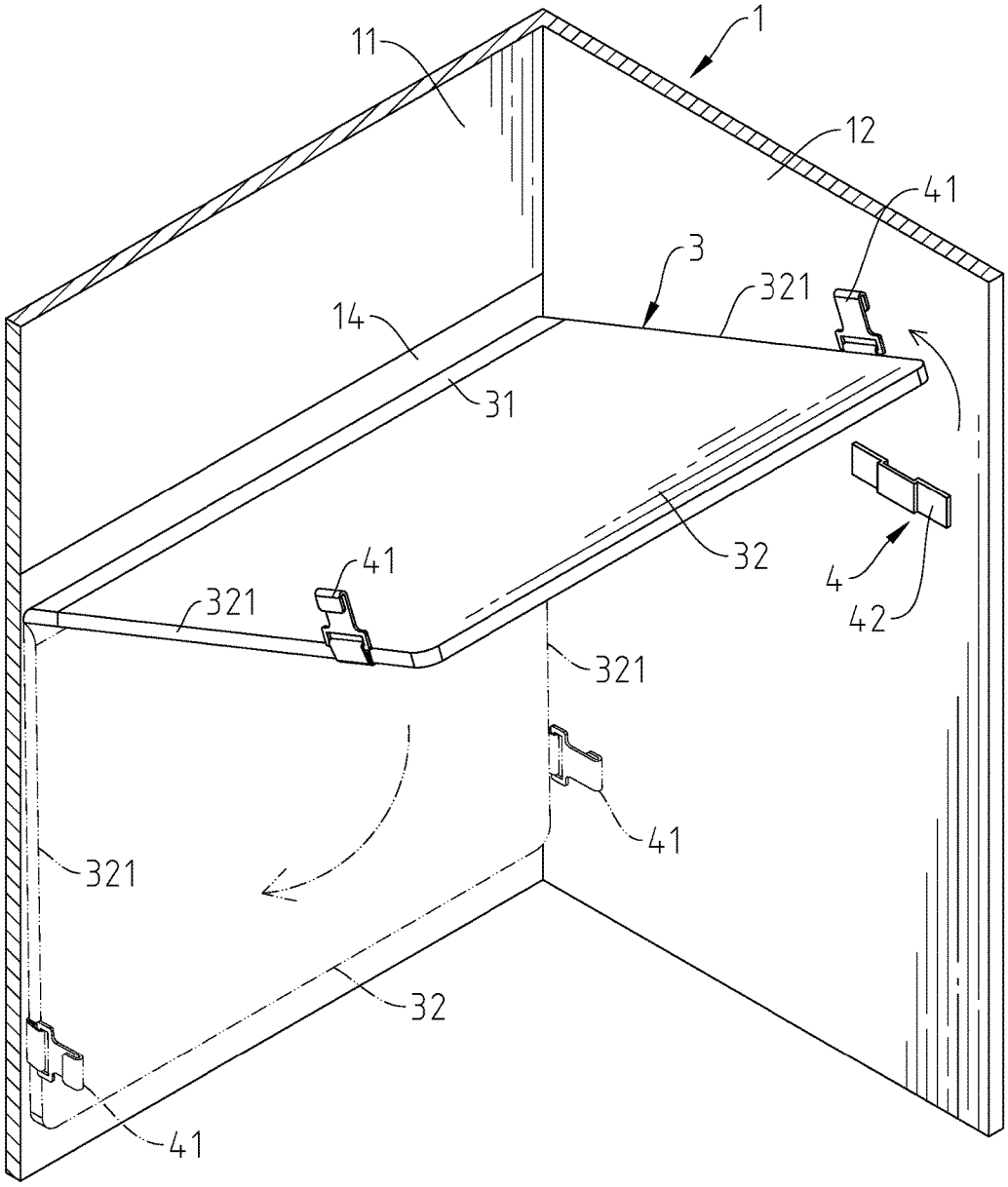
FIG. 5 is a schematic drawing of the present invention, illustrating the unfastening operation of the connection devices for the collapsing of the support plate.
Figure 6:
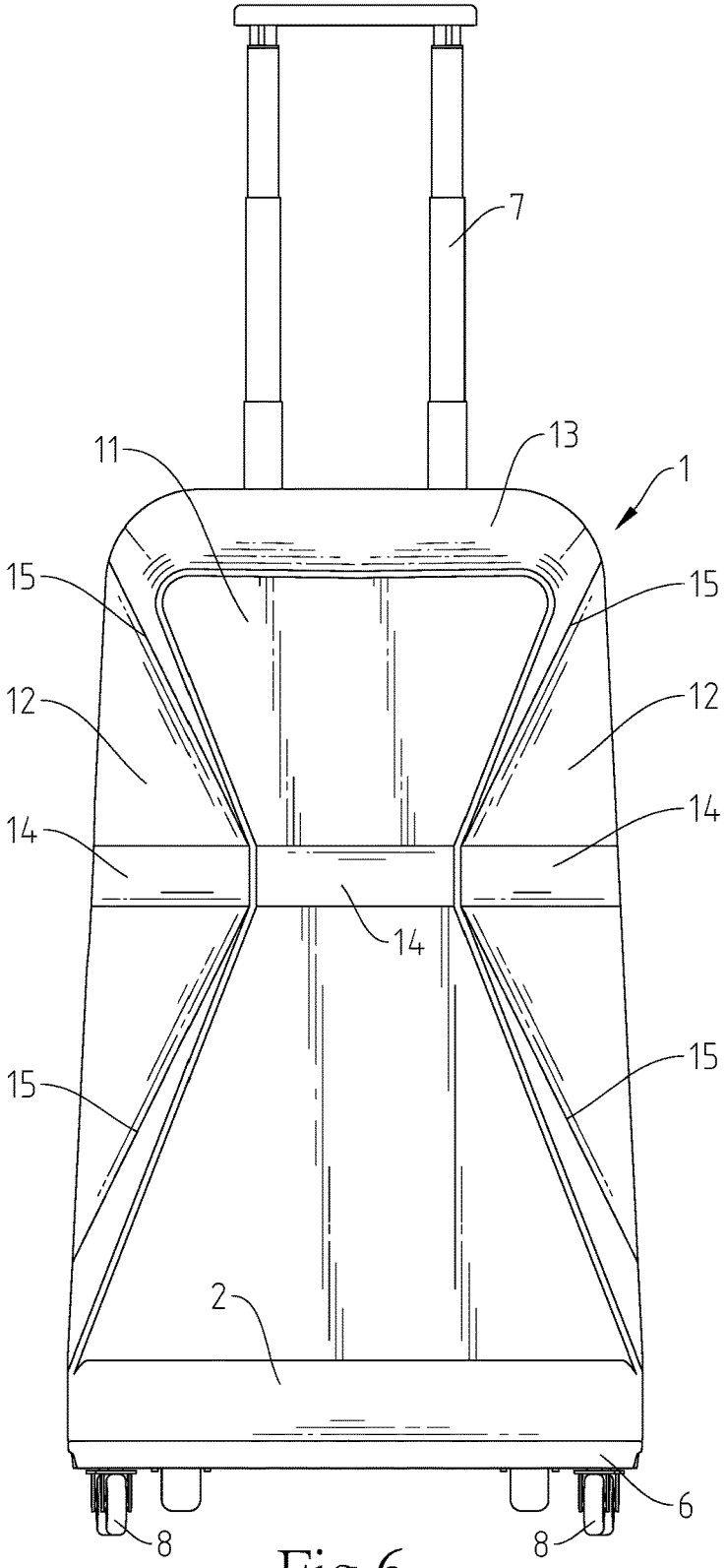
FIG. 6 is a schematic drawing of the present invention, illustrating the collapsing operation of the luggage body.
Figure 7:
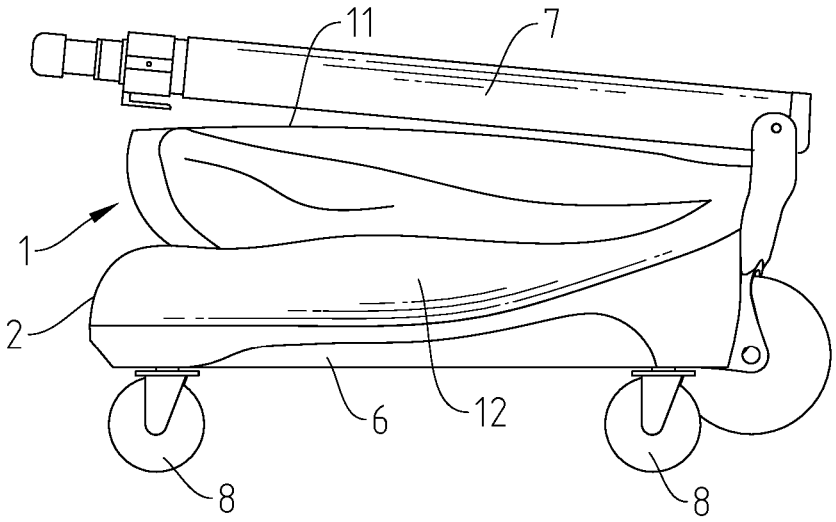
FIG. 7 illustrates the luggage body fully collapsed in accordance with the present invention.

Referring to FIGS. 1-3, when using the luggage body 1, fastened the first connection members 41 of the connection devices 4 to the respective second connection members 42, enabling the bearing edges 321 of the plate body 32 of the support plate 3 to be abutted against the side panels 12 of the luggage body 1 in the partition space portion 14. At this time, the plate body 32 supports the side panels 12 of the luggage body 1 vertically in shape, and divide the inside space of the luggage body 1 into two vertically spaced storage compartments for application. When collapsing the luggage body 1, as illustrated in FIGS. 4-7, disengage the first connection members 41 from the respective second connection members 42, and then bias the plate body 32 into abutment against the back panel 11 of the luggage body 1, and then fold up the side panels 12 along the folding lines 15 into abutment against the back panel 11 to carry the top panel 13 toward the back panel 11, allowing the luggage body 1 to be folded up on the partition space portion 14 into a flat condition.

Figure 8:
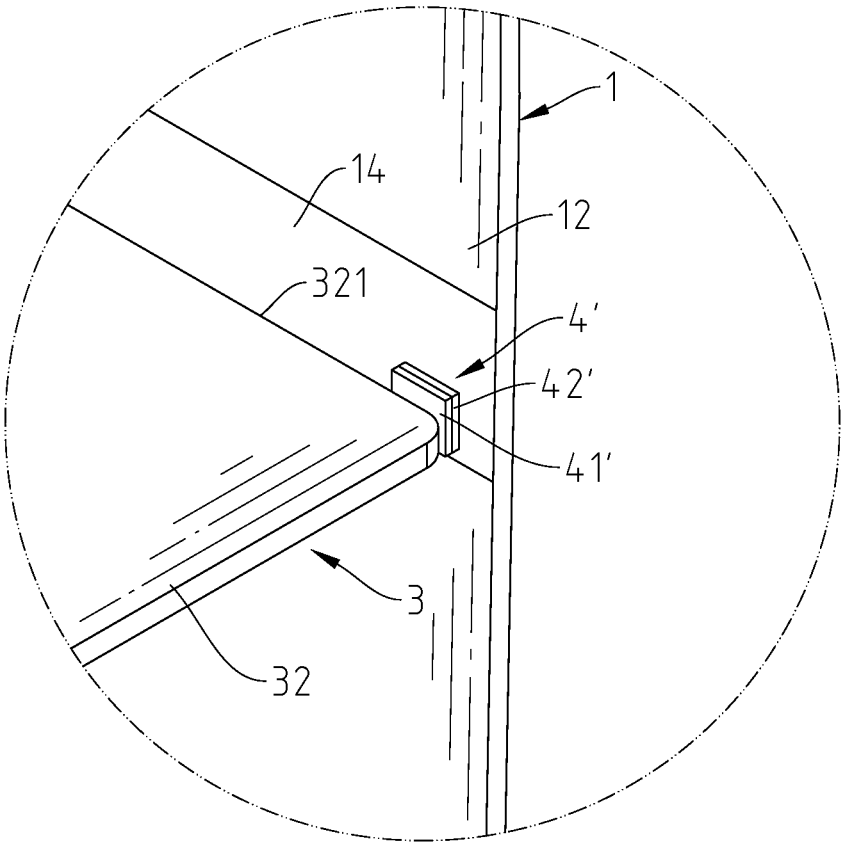
FIG. 8 illustrates an alternate form of the connection device in accordance with the present invention.

Referring to FIG. 8, in an alternate form of the present invention, the first connection members 41' and second connection members 42' of the connection devices 4' are magnetic members and respectively detachably connected together by means of magnetic attraction to hold the support plate 3 in such a position where the bearing edges 321 of the support plate 3 are respectively abutted against the side panels 12 of the luggage body 1 within the partition space portion 14.

What is claimed is:

1. A folding collapsible luggage, comprising:

a luggage body made of a folding collapsible material, said luggage body comprising a back panel, two side panels respectively connected to two opposite lateral sides of said back panel, a top panel connected to a top side of said back panel, a substantially U-shaped partition space portion transversely defined on a middle part of said back panel and a respective middle part of each said side panel, and a V-shaped folding line formed on each said side panel with two opposite ends thereof abutting said back panel and a midpoint thereof located on the respective said side panel within said partition space portion and remote from said back panel;

a support plate comprising a plate body and a hinge strip connected between said plate body and a part of said back panel of said luggage body within said partition space portion, said plate body comprising two bearing edges respectively located at two opposite lateral sides thereof and respectively abutting two opposite ends of said hinge strip; and two connection devices each comprising a first connection member and a second connection member, the said first connection members of said two connection devices being respectively mounted at the said bearing edges of said plate body of said support plate, the said second connection members of said two connection devices being respectively mounted at said side panels of said luggage body within said partition space portion for the connection of the respective said first connection members;

wherein fastening the said first connection members of said connection devices to the respective said second connection members enables the said bearing edges of said plate body of said support plate to be respectively abutted against said side panels of said luggage body within said partition space portion;

unfastening the said first connection members of said connection devices from the respective said second connection members allows said plate body of said support plate to be collapsed and closely abutting said back panel of said plate body and also allows said luggage body to be folded up through said folding lines; and said luggage body further comprises a cover panel made of a folding collapsible material, and a zip fastener mounted between said side panels and said top panel of said luggage body and said cover panel and operable to close said cover panel to said side panels and said top panel or to open said cover panel from said side panels and said top panel.

2. The folding collapsible luggage as claimed in claim 1, further comprising a bottom block, a retractable handle fastened to a rear side of said bottom block, and a plurality of rollers mounted at a bottom side of said bottom block, wherein said luggage body is mounted on said bottom block and further comprises a cover panel that is fixedly fastened to said bottom block and detachably fastenable to said side panels and said top panel; and said back panel of said luggage body has a lower part thereof fastened to said retractable handle below said partition space portion.

3. The folding collapsible luggage as claimed in claim 1, wherein the said first connection member and said second connection member of each said connection device are magnets that attract each other by means of magnetic attraction.

4. The folding collapsible luggage as claimed in claim 1, wherein the said first connection member of each said connection device is a hook member, and the said second connection member of each said connection device is a striker for the hooking of the associating said first connection member.

5. The folding collapsible luggage as claimed in claim 1, wherein said plate body of said support plate is made of a non-foldable hard material.

* * * * *